US007235927B2

(12) United States Patent
Yoo

(10) Patent No.: US 7,235,927 B2
(45) Date of Patent: Jun. 26, 2007

(54) PLASMA DISPLAY PANEL HAVING LIGHT ABSORBING LAYER TO IMPROVE CONTRAST

(75) Inventor: Sung-Hune Yoo, Asan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 181 days.

(21) Appl. No.: 10/856,754

(22) Filed: Jun. 1, 2004

(65) Prior Publication Data

US 2005/0035713 A1 Feb. 17, 2005

(30) Foreign Application Priority Data

Aug. 13, 2003 (KR) ..... 10-2003-0056004

(51) Int. Cl.
*H01J 17/49* (2006.01)

(52) U.S. Cl. ..... 313/586; 313/582; 313/584; 313/585

(58) Field of Classification Search ..... 313/581–603, 313/24

See application file for complete search history.

(56) References Cited

U.S. PATENT DOCUMENTS 4,692,662 A 9/1987 Wada et al.
5,541,479 A * 7/1996 Nagakubo ..... 313/586
5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Sikha Roy
(74) *Attorney, Agent, or Firm*—Robert E. Bushnell, Esq.

(57) ABSTRACT

A plasma display panel having improved contrast without needing an additional manufacturing process includes: a transparent front substrate, a rear substrate arranged on a lower portion of the front substrate; sustain electrode pairs arranged parallel to each other and located between the front substrate and the rear substrate; a transparent first dielectric layer covering the sustain electrode pairs; address electrodes crossing the sustain electrode pairs and arranged between the sustain electrode pairs and the rear substrate; a second dielectric layer of a light absorbing color covering the address electrodes; transparent partition walls arranged on the second dielectric layer and defining light emitting cells; phosphor layers arranged in the light emitting cells; and a discharge gas filling the light emitting cells.

7 Claims, 7 Drawing Sheets

U.S. PATENT DOCUMENTS

| | | | | |
|---|---|---|---|---|
| RE37,444 | E | 11/2001 | Kanazawa | |
| 6,333,600 | B1 * | 12/2001 | Mizobata | 313/587 |
| 6,344,715 | B2 * | 2/2002 | Tokunaga et al. | 315/169.4 |
| 6,417,620 | B1 | 7/2002 | Yasue | |
| 6,580,216 | B1 | 6/2003 | Lu et al. | |
| 6,630,916 | B1 | 10/2003 | Shinoda | |
| 6,650,051 | B1 | 11/2003 | Park et al. | |
| 6,707,436 | B2 | 3/2004 | Setoguchi et al. | |
| 2003/0102477 | A1 * | 6/2003 | Lee | 257/72 |

FOREIGN PATENT DOCUMENTS

| | | | |
|---|---|---|---|
| JP | 2845183 | | 10/1998 |
| JP | 11-67105 | | 3/1999 |
| JP | 2917279 | | 4/1999 |
| JP | 11-283510 | | 10/1999 |
| JP | 2001-043804 | | 2/2001 |
| JP | 2001-325888 | | 11/2001 |
| KR | 2002-9272 | | 2/2002 |
| KR | 2003-44667 | | 6/2003 |
| TW | 567520 | A * | 12/2003 |

OTHER PUBLICATIONS

*Notice to Submit Response*, Apr. 27, 2005 issued by the Korean Intellectual Property Office in Applicant's co-pending Korean priority application assigned Serial No. 10-2003-56004.

Japanese Office Action for Japanese Patent Application No. 2004-226118, issued on Dec. 19, 2006.

* cited by examiner

PLASMA DISPLAY PANEL HAVING LIGHT ABSORBING LAYER TO IMPROVE CONTRAST

This application makes reference to, incorporates the same herein, and claims all benefits accruing under 35 U.S.C. § 119 from an application for PLASMA DISPLAY PANEL earlier filed in the Korean Intellectual Property Office in 13 Aug. 2003 and there duly assigned Serial No.2003-56004.

BACKGROUND OF THE INVENTION

1. Field of the Invention

The present invention relates to a plasma display panel, and more particularly, to a plasma display panel with improved contrast.

2. Description of the Related Art

U.S. Pat. No. 4,692,662, discussed below, relates to light-emitting cells of a display device that are individually provided with inner walls at least partially covered by white reflectors consisting of glass material containing transparent particles having different refractive indicies of 5 to 80% by weight, so that extremely high luminous efficiency similar to that of an optical integrating sphere can be realized. Also, openings for emitting colored light can be applied with color filters while the front surface other than those openings of the display device is covered with light-absorbing black material, so that the reflectance for incident ambient light can be reduced.

U.S. Pat. No. 5,952,782, discussed below, relates to a surface discharge plasma display panel including a pair of front and rear substrates with a discharge space therebetween and a plurality of display electrode pairs on an internal surface of either the front or rear substrate. The display electrodes extend along each display line. The plasma display panel further includes a light shielding film having a belt shape extending along the surface of the front substrate to overlap each area between the adjacent display lines and sandwiched between the display electrodes.

The following patents each discloses features in common with the present invention but do not teach or suggest the inventive features specifically recited in the present application: U.S. Pat. No. 6,417,620 to Yasue, entitled SURFACE DISCHARGE PLASMA DISPLAY PANEL HAVING TWO-DIMENSIONAL BLACK STRIPES OF SPECIFIC SIZE AND SHAPE, issued on Jul. 9, 2002; U.S. Pat. No. 6,580,216 to Lu et al., entitled HIGH CONTRAST PDP AND A METHOD FOR MAKING THE SAME, issued on Jun. 17, 2003; and U.S. Pat. No. 6,650,051to Park et al., entitled PLASMA DISPLAY PANEL, issued on Nov. 18, 2003.

SUMMARY OF THE INVENTION

The present invention provides a plasma display panel having improved contrast without requiring an additional manufacturing process.

The present invention also provides a plasma display panel having improved chromaticity.

The present invention also provides a plasma display panel having an improved appearance.

According to an aspect of the present invention, a plasma display panel is provided having a display area comprising: a transparent front substrate; a rear substrate arranged below the front substrate; sustain electrode pairs arranged parallel to each other and located between the front substrate and the rear substrate; a transparent first dielectric layer covering the sustain electrode pairs; address electrodes crossing the sustain electrode pairs and arranged between the sustain electrode pairs and the rear substrate; a second dielectric layer of a light absorbing color, the second dielectric layer covering the address electrodes; transparent partition walls arranged on the second dielectric layer and defining light emitting cells; phosphor layers arranged in the light emitting cells; and a discharge gas filling the light emitting cells.

The light absorbing color can be black. The first dielectric layer can be covered with an MgO film.

According to another aspect of the present invention, a plasma display panel is provided having a display area comprising: a transparent front substrate; a rear substrate arranged below the front substrate; sustain electrode pairs arranged parallel to each other and located between the front substrate and the rear substrate; a first dielectric layer having a first color and covering the sustain electrode pairs; address electrodes crossing the sustain electrode pairs and arranged between the sustain electrode pairs and the rear substrate; a second dielectric layer having a second color complementary to the first color, the second dielectric layer covering the address electrodes; transparent partition walls arranged on the second dielectric layer and defining light emitting cells; phosphor layers arranged in the light emitting cells; and a discharge gas filling the light emitting cells.

One of the first color and second colors can be blue, and the other color can be red. Alternatively, one of the first color and second colors can be blue, and the other color can be yellow.

The first dielectric layer can be covered with an MgO film.

According to another aspect of the present invention, a plasma display panel is provided having a peripheral area comprising: a transparent front substrate; a rear substrate arranged below the front substrate; a transparent first dielectric layer arranged between the front substrate and the rear substrate; and a second dielectric layer of a light absorbing color, the second dielectric layer not covered by a phosphor layer and arranged between the first dielectric layer and the rear substrate.

The light absorbing color can be black.

According to another aspect of the present invention, a plasma display panel is provided having a peripheral area comprising: a transparent front substrate; a rear substrate arranged below the front substrate; a first dielectric layer of a first color arranged between the front substrate and the rear substrate; and a second dielectric layer of a second color which is complementary to the first color, the second dielectric layer not covered by a phosphor layer and arranged between the first dielectric layer and the rear substrate.

One of the first color and second colors can be blue, and the other color can be red. Alternatively, one of the first color and second colors can be blue, and the other color can be yellow.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
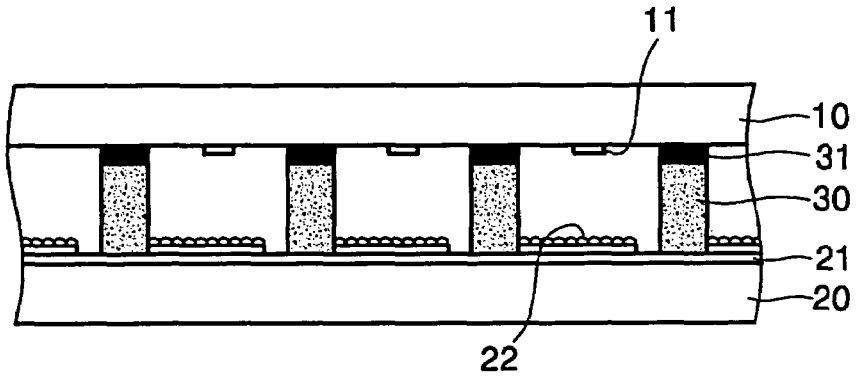
FIG. 1 (PRIOR ART)
FIG. 1 is a cross-sectional view of a conventional display panel.

FIG. 1 is a cross-sectional view of a display panel discussed in U.S. Pat. No. 4,692,662. The display panel comprises a rear substrate 20 on which a cathode 21 is formed, a front substrate 10 on which an anode 11 is formed, and partition walls 30 interposed between the rear substrate 20 and the front substrate 10. Phosphor layers 22 formed on the cathode 21 emit light as a driving signal is applied across the cathode and the anode. Black layers 31 are formed on the partition walls 30 for contrast enhancement.

However, an extra process is needed in the manufacture of the above-noted display panel for forming the black layers 31, thereby increasing the manufacturing time and manufacturing cost.

Figure 2:
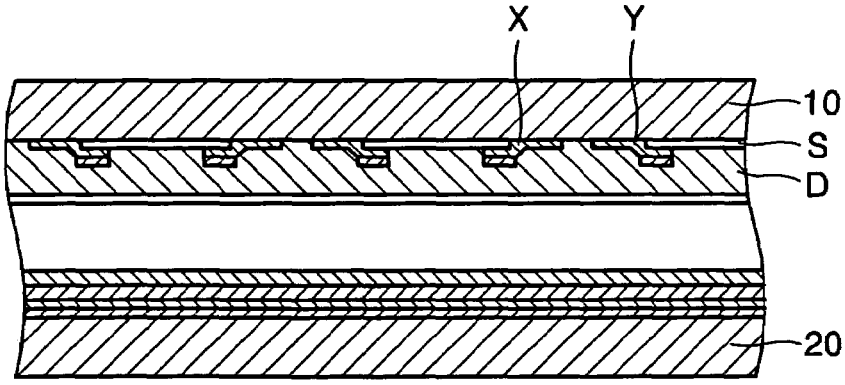
FIG. 2 (PRIOR ART)
FIG. 2 is a cross-sectional view of another conventional display panel.

FIG. 2 depicts a display panel discussed in U.S. Pat. No. 5,952,782. This display panel comprises a front and rear substrates 10 and 20. X and Y discharge electrodes are sequentially formed under the front substrate 10, and a dielectric layer D covers the X and Y electrodes. A discharge in this display panel occurs between the adjacent X and Y electrodes. Light shielding films S are disposed between the X and the Y electrodes where no discharge occurs. The light shielding films S can be black for contrast enhancement.

However, forming the light shielding films S requires an additional process, thereby increasing the manufacturing time and manufacturing cost of the display panel.

Figure 3:
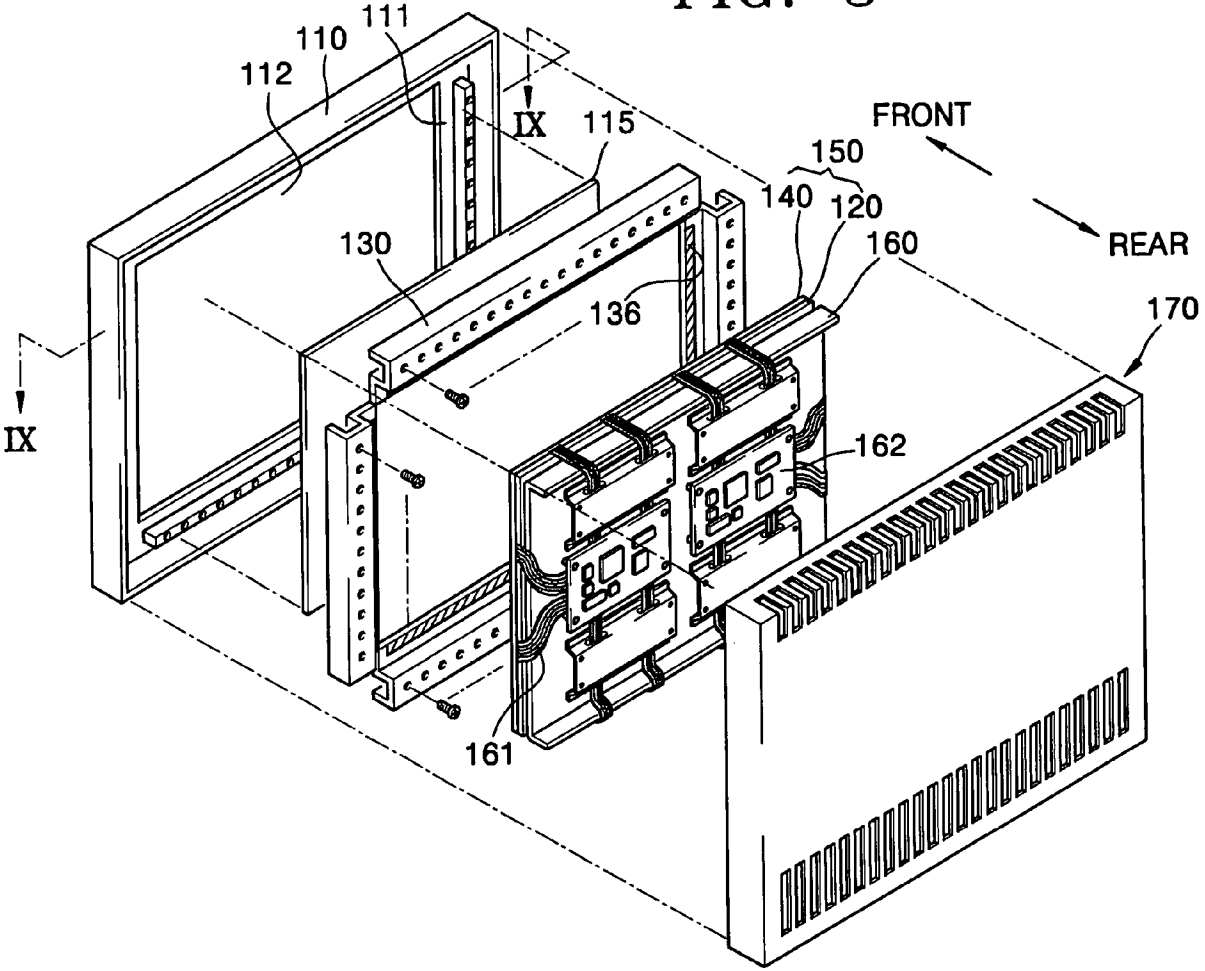
FIG. 3 is an exploded perspective view of a plasma display apparatus having a plasma display panel according to an embodiment of the present invention.

Referring to FIG. 3, a plasma display apparatus according to an embodiment of the present invention includes a plasma display panel 150 including an upper panel 140 and a lower panel 120, a front cabinet 110 having a peripheral portion 111 that blocks a peripheral area of the plasma display panel and defines a window 112, an electromagnetic wave shielding filter 115 disposed between the front cabinet 110 and the plasma display panel 150, a chassis 160 that supports the plasma display panel 150, a circuit portion 162 that drives the plasma display panel 150 and is disposed on the rear of the chassis 160, and a rear cabinet 170 to be joined with the front cabinet 110 and disposed on a rear side of the circuit portion 162.

The electromagnetic wave shielding filter 115 contacts the rear surface of the front cabinet 110 via a filter holder 130, and the plasma display panel 150 contacts a sealing member 136 attached to the rear side of the filter holder 130. The circuit portion 162 for driving the plasma display panel is connected to the plasma display panel 150 via a flexible printed cable (FPC) 161.

Figure 4:
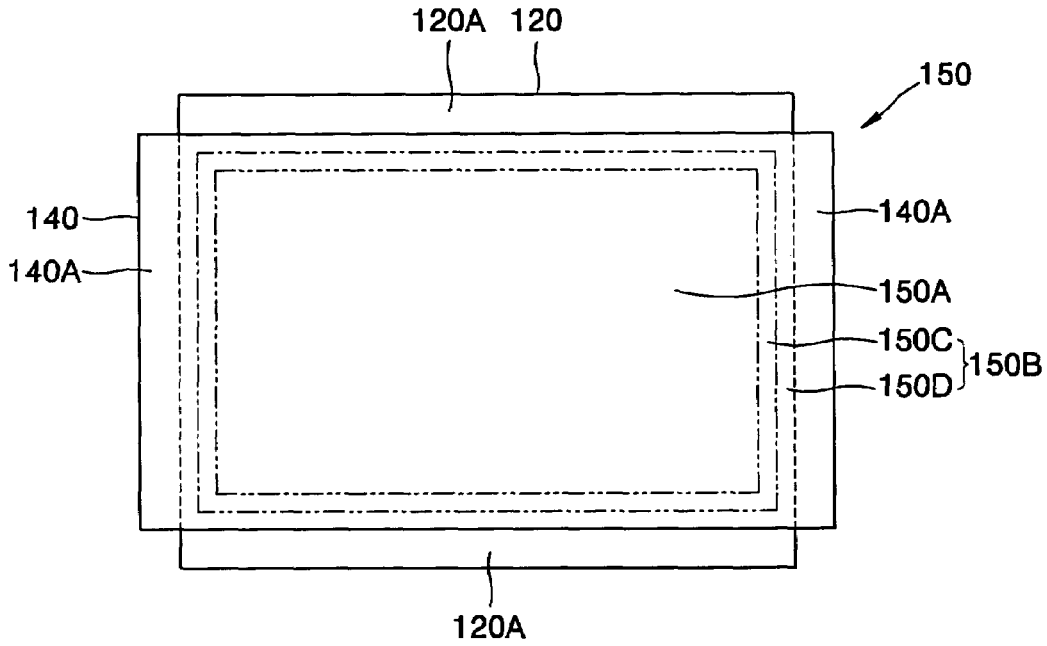
FIG. 4 is a front view of the plasma display panel in FIG. 3.

As shown in FIG. 4, the plasma display panel 150 includes a display area 150A and a peripheral area 150B that surrounds the display area 150A. The peripheral area 150B includes a first peripheral area 150C surrounding the display area 150A and a second peripheral area 150D surrounding the first peripheral area 150C.

The display area 150A displays an image through the window 112 of the front cabinet 110, and the first peripheral area 150C has the same structure as the display area 150A, except for having a phosphor layer. The structure of the display area 150A will be described later. A fritz for sealing the upper panel 140 and the lower panel 120 is disposed in the second peripheral area 15OD. Sustain electrodes are connected to the cables 161 at left and right portions 140A of the upper panel 140, and address electrodes are connected to the cables 161 at upper and/or lower portions 120A of the lower panel 120.

Figure 5:
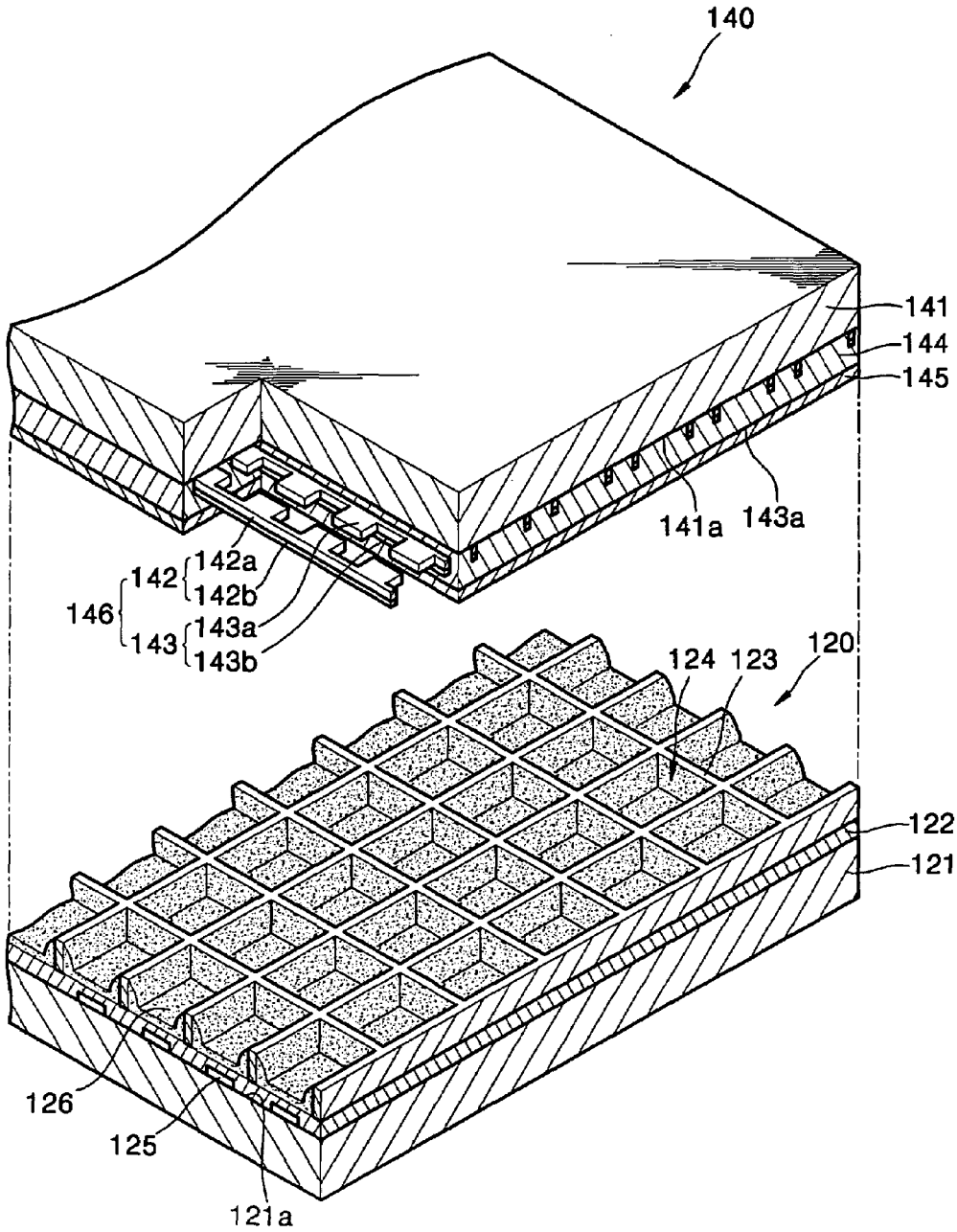
FIG. 5 is an exploded perspective view of a display area of a plasma display panel according to an embodiment of the present invention.

Referring to FIG. 5, the display area 150A of the plasma display panel 150 according to an embodiment of the present invention is described in detail below.

The display area 150A includes a transparent front substrate 141, a rear substrate 121 disposed below the front substrate 141, a sustain electrode pair 146 disposed between the front substrate 141 and the rear substrate 121 and formed parallel to one another on a lower surface 141*a* of the front substrate 141, a transparent first dielectric layer 144 that covers the sustain electrode pair 146, address electrodes 125 disposed between the sustain electrode pair 146 and the rear substrate 121, more specifically, disposed on an upper surface 121*a* of the rear substrate 121 to intersect the sustain electrode pair 146, a second dielectric layer 122 of a light absorbing color, which covers the address electrodes, a transparent partition wall 123, which is formed on the second dielectric layer 122 and defines light emitting cells 124, a phosphor layer 126 formed in each light emitting cell 124, and a discharge gas filling the light emitting cells 124.

The front substrate 141 is formed of a high light transmittance material, such as glass. The rear substrate 121, which supports the address electrodes 125 and the second dielectric layer 122, is formed of a material containing glass as a main component.

The sustain electrode pair 146 includes Y electrodes 142 and an X electrodes 143, and a main discharge for generating an image occurs between the Y electrodes 142 and the X electrodes 143. The Y electrodes 142 and the X electrodes 143 respectively include conductive transparent electrodes 142*a* and 143*a* and bus electrodes 142*b* and 143*b* for preventing a voltage drop caused by the conductive transparent electrodes. The bus electrodes 142*b* and 143*b* are formed in a double layer structure of a conductive material such as silver, aluminum or copper. One layer of the double layer structure, disposed on a front side of the display panel, is black for contrast enhancement, and the other layer disposed on a rear side is a bright color to reflect light emitted from the phosphor layer 126.

The first dielectric layer 144 prevents the Y electrodes 142 and the X electrodes 143 from directly electrically contacting each other, and also prevents charged particles from colliding against the electrodes 142 and 143 during a main discharge. The first dielectric layer 144 is formed of a dielectric material so that it can accumulate wall charges by inducing the charged particles. The dielectric material can be PbO, $B_2O_3$, or $SiO_2$.

The first dielectric layer 144 can be covered with an MgO film 145. The MgO film 145 facilitates the main discharge by generating large numbers of secondary electrons. However, the MgO film 145 is optional.

The address electrodes 125 are used in an addressing discharge which causes a main discharge to occur between the Y electrodes 142 and the X electrodes 143. When the addressing discharge is completed, positive ions are accumulated around the Y electrodes 142, and electrons are accumulated around the X electrodes 143, and therefore, the main discharge between the Y electrodes 142 and the X electrodes 143 is ready to occur.

The second dielectric layer 122 is formed of a dielectric material that induces charged particles and prevents positive ions or electrons from hitting and damaging the address electrodes during addressing discharge. The second dielectric layer 122 be formed of PbO, $B_2O_3$, or $SiO_2$.

The partition wall 123 defines the light emitting cells 124, each of which corresponds to a red light emitting sub-pixel, a green light emitting sub-pixel, and a blue light emitting sub-pixel. The partition wall 123 prevents cross-talk between the light emitting cells 124. In FIG. 5, the partition wall 123 is formed in a matrix form, but can also be formed in a honeycomb structure or another structure.

The phosphor layer 126 contains a component material that generates visible rays by receiving ultraviolet light generated from the main discharge. The phosphor layer 126 formed in the red light emitting sub-pixel contains a phosphor material, such as $Y(V,P)O_4$:Eu, the phosphor layer 126 formed in the green light emitting sub-pixel contains $Zn_2SiO_4$:Mn, $YBO_3$:Tb, and the phosphor layer 126 formed in the blue light emitting sub-pixel contains BAM:Eu.

The red phosphor layer R, the green phosphor layer G, and the blue phosphor layer B are alternately coated on the light emitting cells 124.

The discharge gas filling the light emitting cells 124 is a mixed gas of Ne-Xe and contains 5 wt % of Xe. However, a predetermined amount of Ne can be replaced by He, if necessary.

Figure 6:
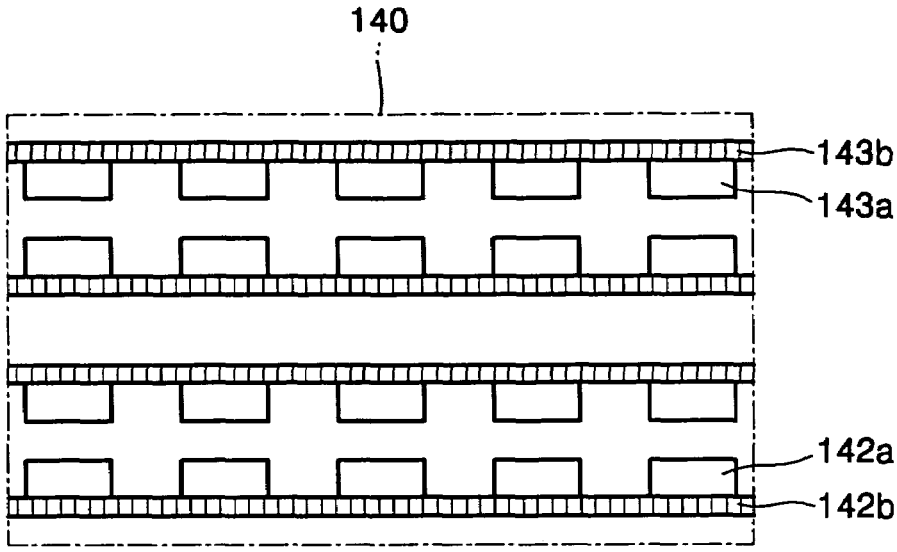
FIG. 6 is a plane view of an upper panel of a plasma display panel according to an embodiment of the present invention.
Figure 7:
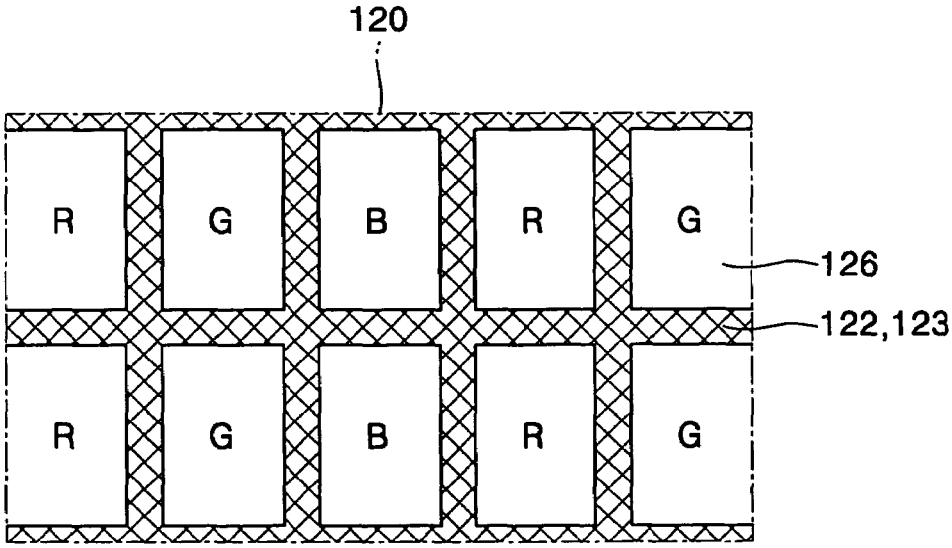
FIG. 7 is a plane view of a lower panel of a plasma display panel according to an embodiment of the present invention.

Referring to FIG. 6 and FIG. 7, all constituent elements of the upper panel 140, except for the bus electrodes 142*b* and 143*b*, are transparent.

The lower panel 120 will be described with reference to FIG. 7. Since the partition walls 123 are formed of a transparent material, such as glass, and the second dielectric layer 122 is formed of a light absorbing color, the phosphor layers 126 coated on the light emitting cell 124 and the second dielectric layer 122 are visible through the top of the lower panel. The light absorbing color is a dark color that absorbs visible light. The dark color can be black but is not limited thereto.

The second dielectric layer 122 can have a light absorbing color by mixing the pigments have a light absorbing color with a transparent dielectric material such as PbO, $B_2O_3$, or $SiO_2$.

Figure 8:
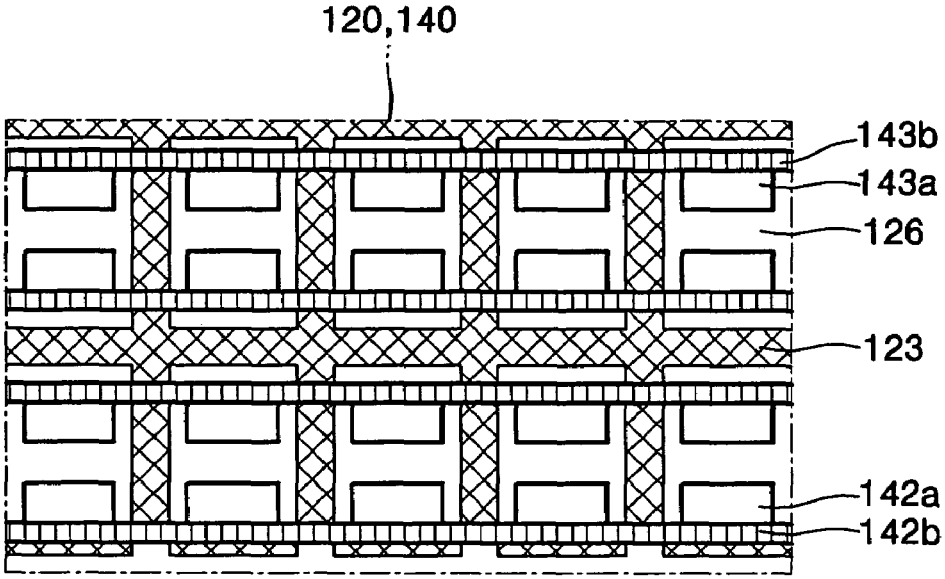
FIG. 8 is a plan view of the assembled upper panel and lower panel.

FIG. 8 is a view of the assembled upper panel 140 and lower panel 120.

Because the display area 150A of the plasma display panel according to the embodiment of the present invention has the structure noted above, external light entering through the upper panel 140 is absorbed by the second dielectric layer 122 after passing through the partition walls 123. Therefore, the contrast of the plasma display panel is improved.

To enhance the contrast of the above plasma display panel, the partition walls 123 are formed of a transparent material, and the second dielectric layer 122 is formed of a material including dark colored pigments. Accordingly, the contrast can be improved without performing an additional costly and time consuming process.

The first peripheral area 150C of the plasma display panel according to the embodiment of the present invention has a similar structure to the display area 150A described above, but it has no phosphor layers 126 in the light emitting cells 124.

Due to errors in manufacturing processes, each peripheral portion of the partition walls 123, the first dielectric layer 144, and the second dielectric layer 122 cannot be formed to have a uniform thickness while central portions thereof are formed to have a uniform thickness. Therefore, the peripheral portions of the partition walls 123, the first dielectric layer 144, and the second dielectric layer 122 are disposed in the first peripheral area 150C that does not contribute to image generation. Therefore, each central portion of the partition walls 123, the first dielectric layer 144, and the second dielectric layer 122 are located in the display area 150A and have a uniform thickness. Both the sustain electrode pair and address electrodes need to be formed in the first peripheral area 150C because the first peripheral area 150C is not involved in image generation.

Figure 9:
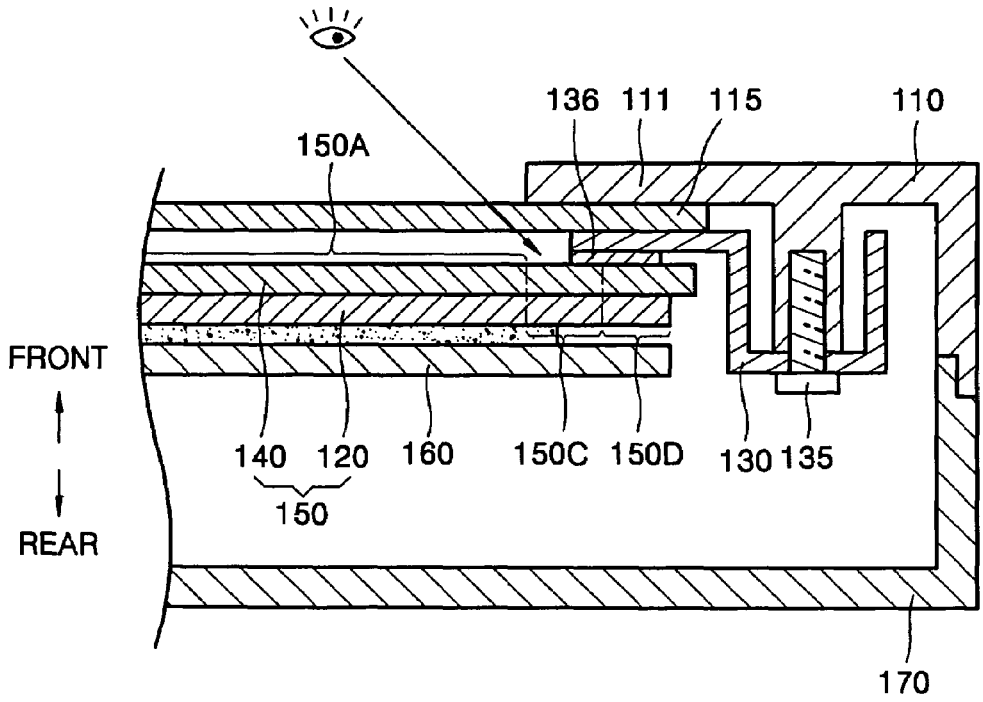
FIG. 9 is a cross-sectional view of the plasma display apparatus taken along line IX-IX in FIG. 3.

The first peripheral area 150C of the conventional plasma display panel has a white phosphor layer. In this case, as seen in FIG. 9, since the dark colored bus electrodes 142*b* and 143*b* in the rear of the peripheral portion 111 of the front cabinet are strongly contrasted with the white from the front of the plasma display apparatus, the appearance of the plasma display panel is not attractive.

However, the peripheral area 150C of the plasma display panel according to an embodiment of the present invention has dark second dielectric layer 122, and the dark bus electrodes 142*b* and 143*b* are not distinguishable from the dark second dielectric layer 122. Therefore, the appearance of the plasma display panel is improved.

The differences between the above-described first embodiment of the present invention and a second embodiment of the present invention are described below.

The main difference of the second embodiment from the first embodiment is that the first dielectric layer 144 has a first color, and the second dielectric layer 122 has a second color, which is complementary to the first color. While the second color can not be perfectly complementary to the first color, the first color and the second color can be sufficiently complementary to each other to exhibit a dark color when overlapped.

The partition walls in this embodiment also are formed of a transparent material, a portion of light entering through the front substrate 141 is absorbed primarily by the first dielectric layer 144, and light passed through the first dielectric layer 144 and the partition walls 123 is absorbed by the second dielectric layer 122. Because the color of the first dielectric layer 144 is a complementary color to the color of the second dielectric layer 122, most of the incident light is absorbed by the first dielectric layer 144 and the second dielectric layer 122. Therefore, the contrast characteristic of the plasma display panel is improved.

A portion of light emitted from the light emitting cells 124 is reflected by the second dielectric layer 122 and transmitted through the front substrate 140. Therefore, it is preferable that the second dielectric layer 122 has a color that is highly reflective to visible light. The light emitted from the light emitting cells 124 is externally discharged through the first dielectric layer 144. Therefore, it is preferable that the first dielectric layer 144 has the same color as the light having the lowest chromaticity. The light having the lowest chromaticity can be a red light emitted from a red phosphor layer R, a green light emitted from a green phosphor layer G, or a blue light emitted from a blue phosphor layer B.

Based on the above, the first dielectric layer 144 is preferably blue because the blue light emitted from the blue phosphor layer B has the lowest light chromaticity. The second dielectric layer 122 needs to be of a complementary color, preferably, red or yellow, to the first dielectric layer 144. When the second dielectric layer 122 is red, a high contrast is achieved since a very dark color, close to black, can be obtained when red is overlapped with blue. When the second dielectric layer 122 is yellow, a high brightness is achieved because yellow has a higher reflection characteristic than red.

By mixing the pigments for red, blue, and yellow with PbO, $B_2O_3$, or $SiO_2$, the dielectric layer can be colored red, blue, or yellow. Preferably, the color of the first and second dielectric layers can be selected according to the light emitting characteristics of the phosphor layers.

As in the first embodiment of the present invention, the second embodiment of the present invention can be applied not only to the display area 150A but also to the first peripheral area 150C.

The present invention provides a plasma display panel with an improved contrast without requiring an additional manufacturing process.

The present invention also provides a plasma display panel with improved chromaticity.

The present invention also provides a plasma display panel with improved appearance.

While this invention has been particularly shown and described with reference to exemplary embodiments thereof, it will be understood by those skilled in the art that various changes in form and details can be made therein without departing from the spirit and scope of the invention as defined by the appended claims.

What is claimed is:

1. A plasma display panel having a display area comprising:

a transparent front substrate;

a rear substrate arranged below the front substrate;

sustain electrode pairs arranged parallel to each other and located between the front substrate and the rear substrate;

a first dielectric layer having a first color and covering the sustain electrode pairs;

address electrodes crossing the sustain electrode pairs and arranged between the sustain electrode pairs and the rear substrate;

a second dielectric layer having a second color complementary to the first color, the second dielectric layer covering the address electrodes;

transparent partition walls arranged on the second dielectric layer and defining light emitting cells;

phosphor layers arranged in the light emitting cells; and a discharge gas filling the light emitting cells.

2. The plasma display panel of claim 1, wherein one of the first and second colors is blue and the other color is red.

3. The plasma display panel of claim 1, wherein one of the first and second colors is blue, and the other color is yellow.

4. The plasma display panel of claim 1, wherein the first dielectric layer is covered with an MgO film.

5. A plasma display panel having a peripheral area comprising:

a transparent front substrate;

a rear substrate arranged below the front substrate;

a first dielectric layer of a first color arranged between the front substrate and the rear substrate; and a second dielectric layer of a second color which is complementary to the first color, the second dielectric layer not covered by a phosphor layer and arranged between the first dielectric layer and the rear substrate.

6. The plasma display panel of claim 5, wherein one of the first and second colors is blue, and the other color is red.

7. The plasma display panel of claim 5, wherein one of the first and second colors is blue, and the other color is yellow.

* * * * *